US008857005B2

(12) United States Patent
Shim et al.

(10) Patent No.: US 8,857,005 B2
(45) Date of Patent: Oct. 14, 2014

(54) BRUSH WITH STRUCTURE FOR HAIR REMOVAL

(75) Inventors: Scott Shim, Columbus, OH (US); Wonmo Koo, Columbus, OH (US)

(73) Assignee: The Ohio State University, Columbus, OH (US)

( * ) Notice: Subject to any disclaimer, the term of this patent is extended or adjusted under 35 U.S.C. 154(b) by 253 days.

(21) Appl. No.: 13/369,844

(22) Filed: Feb. 9, 2012

(65) Prior Publication Data

US 2013/0206183 A1 Aug. 15, 2013

(51) Int. Cl.
*A46B 15/00* (2006.01)

(52) U.S. Cl.
CPC ..... *A46B 15/00* (2013.01)
USPC ..... 15/169; 15/160; 15/104.5; 132/119

(58) Field of Classification Search
CPC .. A46B 15/00; A46B 17/06; A46B 2200/104; A46B 5/0012
USPC ..... 15/168, 169, 160, 104.5; 132/126, 119; 119/628
See application file for complete search history.

(56) References Cited

U.S. PATENT DOCUMENTS 2,266,195 A * 12/1941 Hallock ..... 15/167.1
3,172,139 A * 3/1965 Wire ..... 15/160
D244,568 S 6/1977 Lepisto et al.
4,030,158 A 6/1977 Blair et al.
D249,909 S 10/1978 Epstein
4,864,676 A * 9/1989 Schaiper ..... 15/167.1
5,471,702 A * 12/1995 Schmitt ..... 15/167.1
5,519,912 A 5/1996 Kawamura
5,926,902 A 7/1999 Pierre
6,725,495 B1 4/2004 Habibi
D498,059 S 11/2004 Cheung
7,316,045 B2 1/2008 Koke
7,861,360 B2 1/2011 Malka
7,908,700 B2 3/2011 DiPippo
2009/0013490 A1 1/2009 DiPippo

* cited by examiner

*Primary Examiner* — Shay Karls

(74) *Attorney, Agent, or Firm* — Jason H. Foster; Kremblas & Foster

(57) ABSTRACT

A hair brush that permits quick and easy removal of hair has a handle attached to a head. The head is made up of at least two frames that are mounted to the handle through cantilevers that permit movement of the frames relative to one another. The bristles are mounted to the frames, preferably in single rows. A force applied to one frame moves that frame relative to the other frame and the handle, thereby permitting the user to reach between the frames to remove any hair that is caught in the bristles. The brush allows a gap between the bristles to be enlarged, thereby making removal using human fingers much easier. Repeated movement and return of the frames to their resting position can cause the hair fibers to work away from the bristle bases and make removal much easier.

12 Claims, 6 Drawing Sheets

BRUSH WITH STRUCTURE FOR HAIR REMOVAL

BACKGROUND OF THE INVENTION

The invention relates generally to a device for brushing the hair of at least humans, and preferably also animals. The invention relates specifically to a hair brush with a structure that allows for the ready removal of hair fibers therefrom.

Hairbrushes have been used for years to smooth, style, and detangle human hair and animal fur (both of which are referred to herein as "hair"). Hairbrushes are available in many different shapes, sizes and materials, with each variety being suited to a particular application. For example, flat hairbrushes are normally used for detangling hair, while cylindrical hairbrushes are normally used for styling and curling hair. Regardless of the particular variety, the majority of hairbrushes include a handle that is connected to, or contiguous with, a head having a plurality of bristles extending therefrom.

A problem that is commonly associated with hairbrushes is the accumulation of hair on and between the bristles. During the course of normal use, the bristles of a brush pull hair fibers away from the body of a human or an animal, with some of the hair commonly becoming entangled among the bristles. This problem is especially prevalent with long hair. Short hair generally falls out of brushes due to fewer points of contact with the bristles, and therefore too little friction holding the hair fibers to the bristles. Long hair is much more prone to being woven through multiple bristles, and being retained by friction, thereby resisting falling out by gravity, while abrading against other hair during brushing or movement of air, such as when using a hair dryer.

Hair fibers that accumulate on a hairbrush present an unsanitary condition because accumulated hair contains residue that is brought into contact with the clean hair of a subject upon which the brush is subsequently used. To a smaller degree, accumulated hair can reduce the efficacy of a hairbrush by reducing the effective portion of each bristle that is available to extend into the hair of a subject. That is, the accumulated hair can form a "pad" around the base of the bristles that can act as a barrier to complete penetration of the bristles into a subject's hair during brushing. If a sufficient amount of hair is accumulated on a brush, the bristles can become entirely covered by the hair, thereby rendering the brush useless. Finally, and subject to a user's subjective impression, a lot of hair on a hairbrush gives an unsightly appearance.

Various techniques have been devised for cleaning accumulated hair from the bristles of hairbrushes. One popular technique is to drag the tines of a conventional hair comb through the bristles of the brush, thereby transferring the accumulated hair from the brush to the comb. The hair is subsequently manually pulled from the comb and discarded. It is also known to reach between bristles of a brush with a forefinger and thumb to pinch and remove the hair. While these techniques can be effective, they require significant manual effort, they are time-consuming, and one requires an additional instrument (i.e. a comb) that a user may not have at his or her disposal. Regardless of the difficulty or time consumed, many people find the process of removing hair from a hairbrush to be nauseating.

To avoid the problems associated with cleaning a hairbrush, it is not uncommon for a user to simply dispose of the hairbrush and buy a new one. This is typically long before the useful life of a hairbrush has been exhausted, and often when the hairbrush exhibits little or no physical wear. This practice is wasteful and can be very expensive, especially in the case of professional grade hairbrushes which can cost well over $100.00.

In view of the forgoing, it would be advantageous to provide a hairbrush that can be easily cleaned with minimal manual effort and without the use of additional instruments.

BRIEF SUMMARY OF THE INVENTION

The present invention contemplates an improved hairbrush that is convenient and quick to clean. The embodiments disclosed herein include handles with frames connected thereto through cantilevers that provide the ability of the frames to bend relative to the handle and to at least some of the other frames. The frames have bristles thereon, and the construction described herein provides three-dimensional separation of each frame to permit the user to simply reach between the frames to remove hair extending therebetween. By bending the cantilevers, the frames are separated from their next-adjacent frames.

In a preferred embodiment there are at least two frames, and more preferably three frames. The first and third frames move substantially together relative to the second frame, which creates a gap between the adjacent frames into which human fingers can readily reach to pinch and pull the hair fibers. The number of frames is not critical, and another embodiment includes four frames.

The cantilevers connect a handle to the series of preferably concentric frames. The center cantilever preferably extends straight to a first, central frame. Two outer cantilevers extend out to a fourth frame that encircles the first frame. The left outer cantilever extends to a U-shaped, second frame that extends around the central frame but within the outer, fourth frame. The central cantilever has a U-shaped, third frame that extends around the second frame but within the outer, fourth frame. The cantilevers are connected to the handle and to the frames. This construction permits the frames connected to the same cantilever to move together, and minimally affect frames on other cantilevers. Thus, when the fourth frame is moved relative to the handle, the second frame moves, too. At the same time, the first and third frames stay essentially stationary relative to the handle. This provides movement of every other (odd-numbered) frame, with the even-numbered frames staying stationary.

Figure 1:
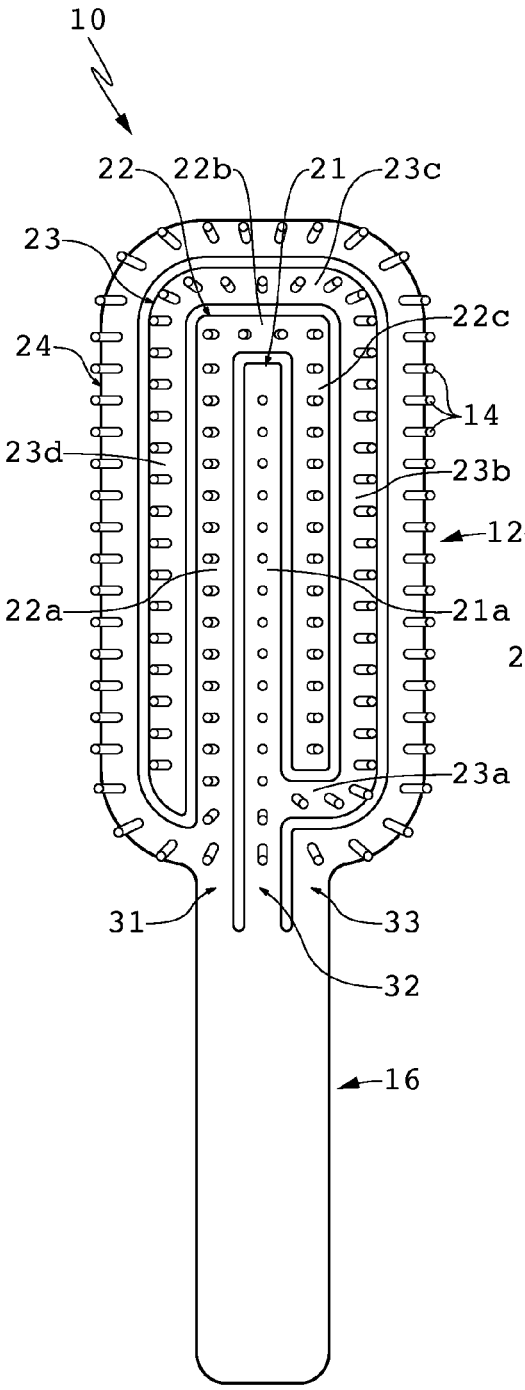
FIG. 1 is a front view illustrating an embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word "connected" or terms similar thereto are often used. They are not limited to direct connection, but include connection through other elements where such connection is recognized as being equivalent by those skilled in the art.

DETAILED DESCRIPTION OF THE INVENTION

An improved hairbrush for facilitating the convenient removal of accumulated hair fibers therefrom is indicated generally at 10. For the sake of convenience and clarity, terms such as "top," "bottom," "front," "rear," "length," "width," "lateral," and "longitudinal" will be used herein to describe the relative size and orientation of various components of the invention, all with respect to the geometry and orientation of the hairbrush as it appears in FIG. 1. This terminology will include the words specifically mentioned, derivatives thereof, and words of similar import.

Figure 2:
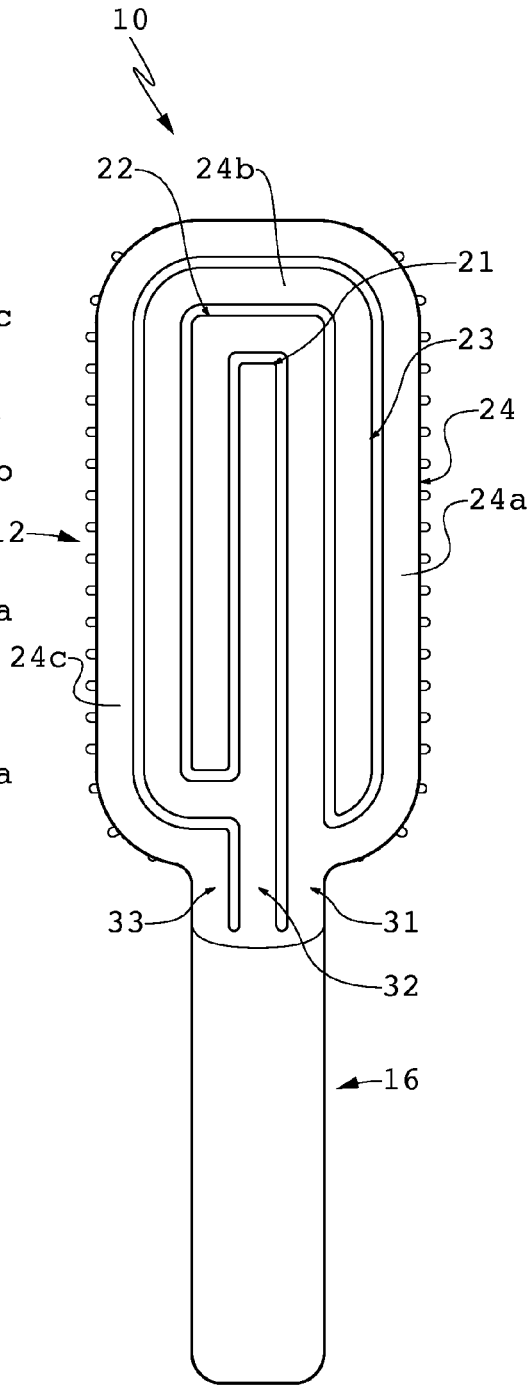
FIG. 2 is a rear view illustrating the embodiment of FIG. 1.
Figure 3:
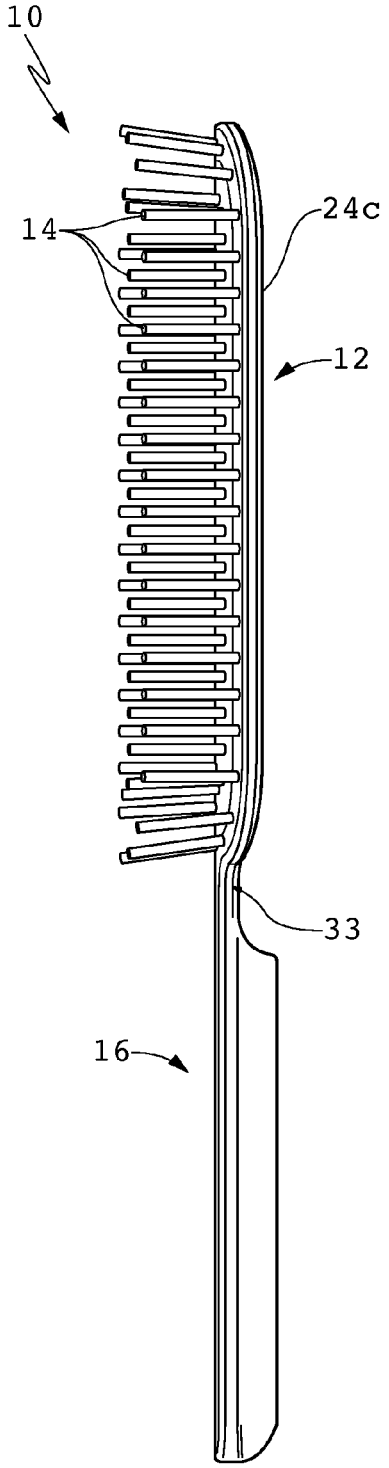
FIG. 3 is a side view illustrating the embodiment of FIG. 1.

Referring to FIGS. 1-3, the hairbrush 10 includes a head 12 with a plurality of bristles 14 mounted thereto. The head 12 is preferably formed of a substantially rigid, preferably plastic material having a predetermined elasticity. One material contemplated for the head and the bristles is a thermosetting plastic, although this is not critical. The bristles 14 are preferably formed of a plastic material that is more rigid than the material of the head 12, but this is similarly not critical. It is contemplated that the head 12 and/or the bristles 14 can alternatively be formed of any of a variety of other suitable materials that enable the hairbrush to function as described below. These include, but are not limited to, metals, woods and other natural materials, plastics and composite materials. For example, the head can be made of wood with polymer bristles. Alternatively, the head can be made of fiber-reinforced polymer and the bristles made of natural fibers. The materials that can be used will be apparent to the person having ordinary skill from the disclosure herein.

An elongated handle 16 extends from the head 12. The handle is a conventional hairbrush handle shape and size that is intended to be manually grasped by a user in a conventional manner during use of the hairbrush 10. The particular size and shape of the handle 16 are not critical to the invention and can be varied greatly as will be appreciated by those of ordinary skill in the art. For example, relative to the handle 16 shown, alternative handles can be flatter, rounder, thinner, thicker, shorter, longer and/or more curved. The primary purpose of the handle 16 is to form a structure that can be grasped by the average person's hand. The handle 16 can also be formed with various well-known ergonomic features for enhancing the comfort and stability of the brush 10 during use, such as a resilient and/or high friction surface or a series of rounded depressions for accepting the fingers of a user.

The handle 16 is preferably a contiguous and integral extension of the head 12, but this is not critical. It is contemplated that the head 12 and the handle 16 can alternatively be formed as separate components, possibly from different materials, and subsequently connected to one another using conventional fastening means, such as mechanical fasteners, adhesives, or another fastener. It is further contemplated that the head 12 can be removably or hingedly mounted to the handle 16 for allowing the brush 10 to be disassembled or collapsed by a user, such as for facilitating convenient and efficient storage of the hairbrush 10 during travel.

Figure 4:
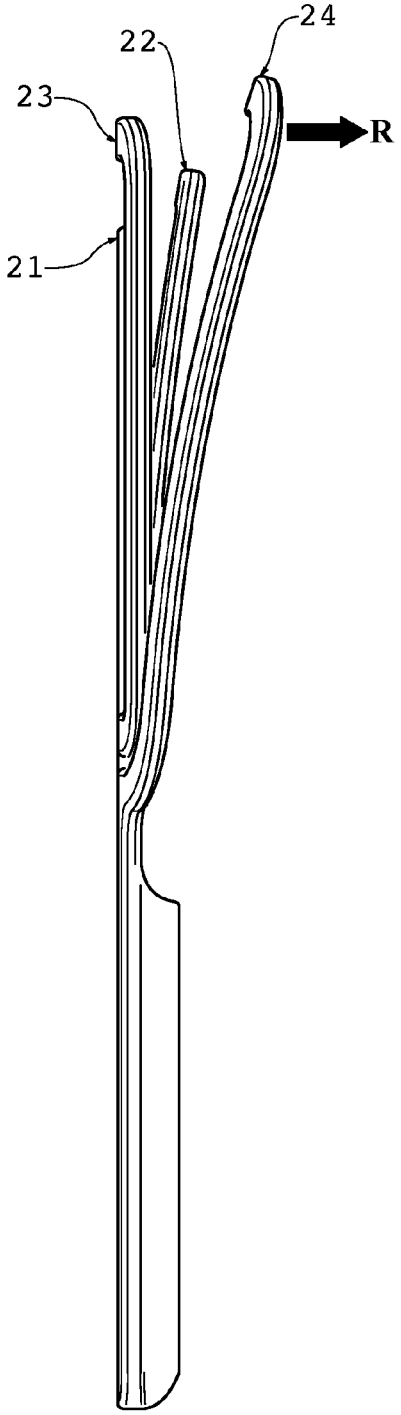
FIG. 4 is a side view illustrating the embodiment of FIG. 1 with the frames thereof spaced relative to one another and the bristles thereof removed for clarity.
Figure 6:
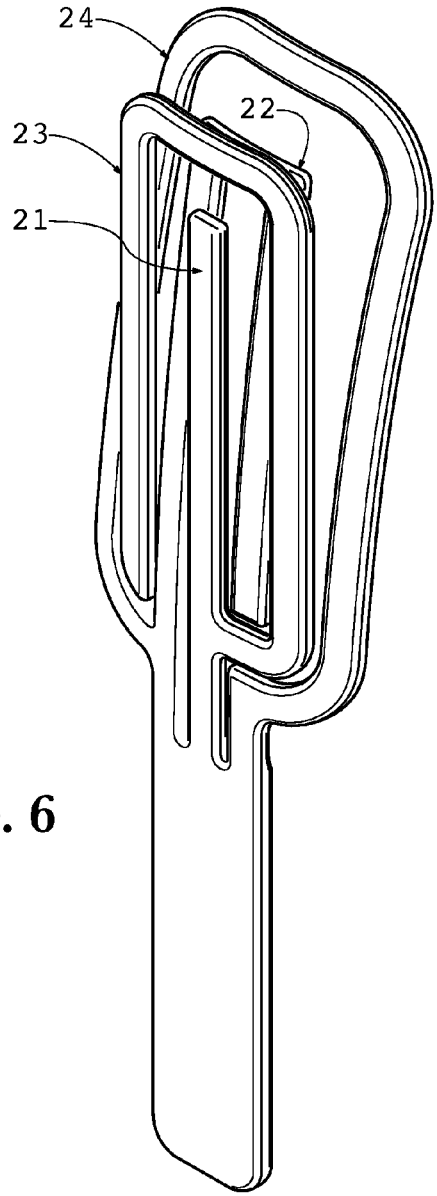
FIG. 6 is a view in perspective illustrating the embodiment of FIG. 4.
Figure 5:
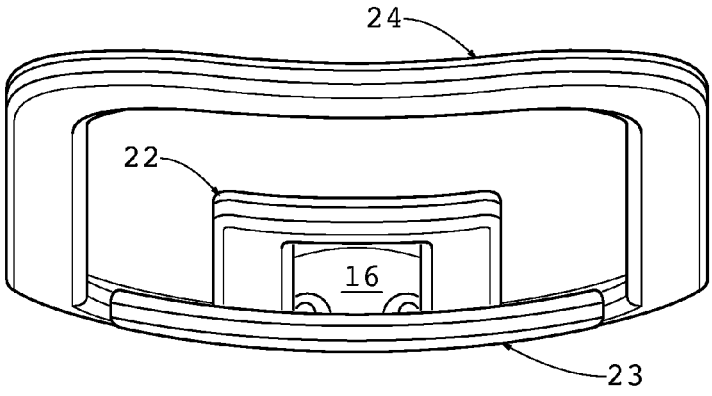
FIG. 5 is a top view illustrating the embodiment of FIG. 4.
Figure 7:
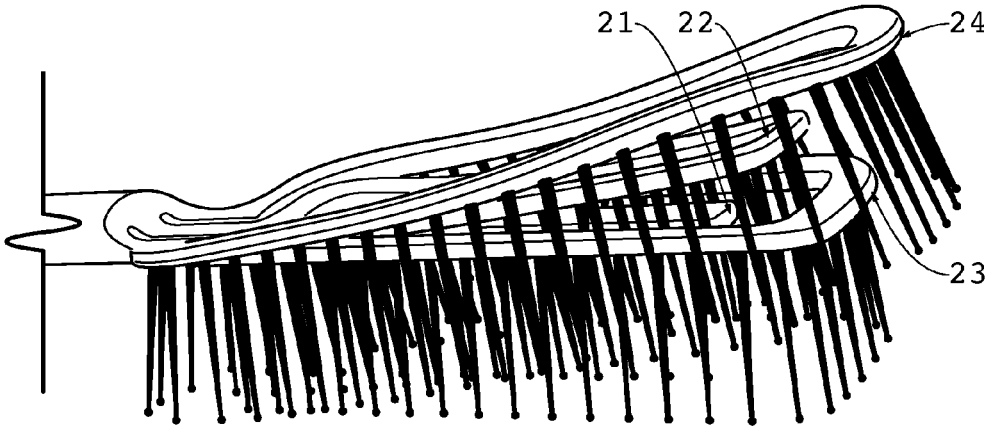
FIG. 7 is a side view in perspective illustrating an embodiment of the present invention with the frames thereof spaced relative to one another.
Figure 8:
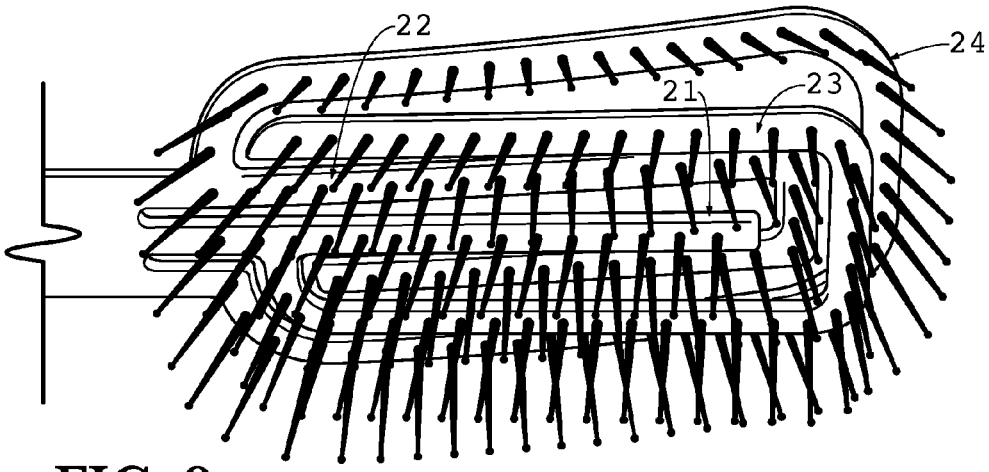
FIG. 8 is a front view in perspective illustrating the embodiment of FIG. 7.
Figure 9:
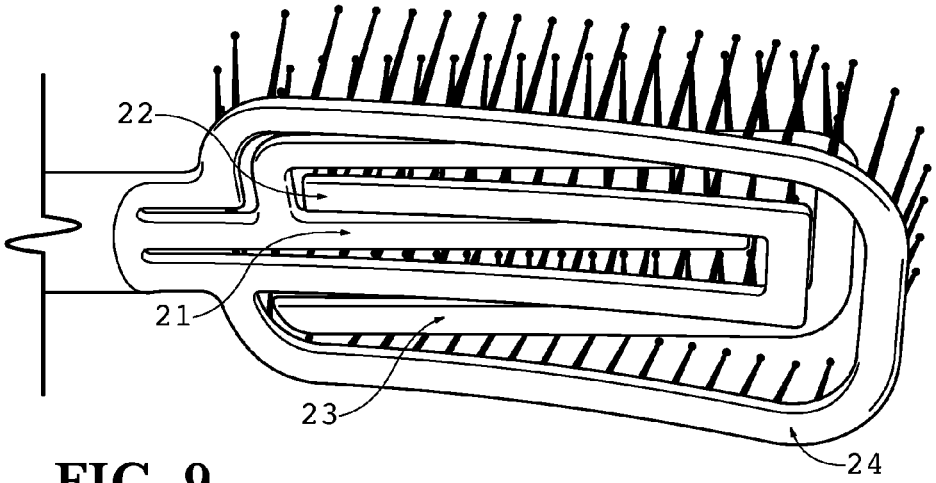
FIG. 9 is a rear view in perspective illustrating the embodiment of FIG. 7.

In FIGS. 4, 5 and 6, the head 12 is shown with the bristles 14 removed to aid in understanding the following description. It is not contemplated to form a hairbrush without bristles, but it should be noted that the principle of the invention can be embodied in other devices, such as spatulas and rakes as noted below, that have no bristles. Nevertheless, the brush 10 is contemplated only with bristles. The head 12 is best viewed with reference to FIGS. 1-2 and 4-6, and is formed of first, second, third and fourth concentric frames 21, 22, 23 and 24, respectively. The frames 21-24 are preferably substantially coplanar with one another and with the handle 16 as shown in FIG. 3, despite the lateral curvature of the head 12 as best seen in FIG. 5. The term "coplanar" does not require compared components to be exactly planar. Instead, the term "coplanar" is defined herein to include generally flat or gently curved structures that have an overall planar configuration, and which are generally within the same plane as another generally flat structure.

As best seen in FIGS. 1-3, the frames 21-24 extend from three substantially parallel cantilevers 31, 32 and 33 that extend from the handle 16. The preferred cantilevers are made of the same material of which the handle 16 and head 12 are constructed. Of course, the preferred cantilevers can be replaced with other structures that accomplish the same purpose, all of which are referred to herein as "cantilevers". "Cantilevers" include, but are not limited to, hinges that resist hinging movement to a predictable degree due to friction or other forces, hinges with integral or incorporated springs (similar to those used on self-closing doors) or springs alone, including leaf, coil, elastomeric, magnetic and gas springs. The critical feature of the cantilevers is that they connect the handle with the frames and permit sufficient relative movement between the handle and the frames, such as by flexure of at least the cantilever, by rotation, as in the hinge, or another phenomenon that permits the required relative movement. Of course, it would be possible to use rigid cantilevers if the frame is flexible enough to move relative to the other frame and the handle.

In the preferred embodiment each cantilever is formed at the end of a frame adjacent the handle, and each is made of the same material of which the frame is made and has similar shape and size as the frame. This makes it difficult to establish a boundary between each cantilever and each attached frame. Indeed, the frame appears to extend directly to the handle. Nevertheless, it will be apparent to the person having ordinary skill that a different type of cantilever can be substituted at the end of the frame between the frame and the handle.

The first frame 21 is formed of a single leg 21*a* that extends parallel to, and contiguously from, the central cantilever 32. The leg 21*a* has a preferred width of about one-quarter inch and a preferred thickness of about one-eighth inch, which are the preferred thickness and width of the cantilever 32. These dimensions can vary significantly depending upon the material used for the cantilevers and the frames, the preferred size of the head 12 and other factors. The frames can be made wider or narrower without departing from the present invention, but must be at least wide enough to facilitate the mounting of bristles thereto as described and shown herein.

The second frame 22 is formed of a first leg 22*a* that extends parallel to, and contiguously from, the cantilever 31.

A second leg 22*b* extends at a substantially right angle to the leg 22*a*, and then a third leg 22*c* extends at a substantially right angle to the leg 22*b*, thereby forming a U-shaped structure surrounding the first leg 21*a*. The legs 22*a*, 22*b* and 22*c* have preferred widths of about one-quarter inch and preferred thicknesses of about one-eighth inch, which are the preferred thickness and width of the cantilever 31. As noted above, these dimensions can vary significantly depending upon the material used for the cantilevers and the frames, along with other factors.

The third frame 23 is formed of a first leg 23*a* that extends at a substantially right angle to, and contiguously from, the cantilever 32. A second leg 23*b* extends at a substantially right angle to the leg 23*a*, a third leg 23*c* extends at a substantially right angle to the leg 23*b*, and a fourth leg 23*d* extends at a substantially right angle to the leg 23*c*, thereby forming a U-shaped structure surrounding the second frame 22. The legs 23*a*, 23*b*, 23*c* and 23*d* have preferred widths of about one-quarter inch and preferred thicknesses of about one-eighth inch, which are the preferred thickness and width of the cantilever 32. As noted above, these dimensions can vary significantly depending upon the material used for the cantilevers and the frames, along with other factors.

As shown in FIG. 2, the fourth frame 24 is formed of a first leg 24*a* that extends contiguously from the cantilever 31. A second leg 24*b* extends at a substantially right angle to the leg 24*a* and a third leg 24*c* extends at a substantially right angle to the leg 24*b* and extends contiguously from the cantilever 33, thereby surrounding the third frame 23. The legs 24*a*, 24*b* and 24*c* have preferred widths of about one-quarter inch and preferred thicknesses of about one-eighth inch, which are the preferred thicknesses and widths of the cantilevers 31 and 33. As noted above, these dimensions can vary significantly depending upon the material used for the cantilevers and the frames, along with other factors.

The frames 21-24 are spaced concentrically relative to one another with the frame 21 being in the center and the frame 24 being on the outside. Concentric gaps are formed between adjacent pairs of the frames 21-24, permitting the frames 21-24 to bend about the cantilevers relative to another without contacting adjacent frames. As noted above, the cantilevers interposed between the handle 16 and the frames 21-24 have the purpose of permitting relative movement of the frames. In the preferred embodiment, the cantilevers 31, 32 and 33 bend to allow this relative movement of the frames and the handle, and the bending is effected as explained in detail below. It will become apparent to the person having ordinary skill how to substitute other, perhaps more complex, cantilevers for the integral, contiguous structures that are shown as the cantilevers 31, 32 and 33 in FIG. 1, with concomitant benefits and costs. Such structures are contemplated herein to be equivalent to the cantilevers 31, 32 and 33.

The frames 21-24 have a relatively complex appearance, but their operation is readily described: each frame contains bristles and is moveable relative to next-adjacent frames to enlarge the gaps between adjacent frames to permit insertion of fingers or an instrument to remove hair fibers. This provides the user with the ability to rapidly, conveniently and thoroughly remove any hair fibers that extend from bristles on one frame to bristles on another frame. Many combinations of frame sizes, proportions and shapes will become apparent from the description herein, and each of those is contemplated by the invention.

The leg 21*a* extends substantially parallel away from the handle 16 to a free, terminal end spaced from the handle 16. The leg 21*a* is preferably about three inches long, but this is not critical. The leg 21*a* can be made longer or shorter without departing from the present invention, and has a length in a range between about two inches and about eight inches. A single row of bristles 14 is preferably mounted on the leg 21*a*, but this is not essential. As an alternative, multiple rows of bristles could be mounted on the leg 21*a*. The bristles 14 on the leg 21*a* are spaced from one another no more than about one inch, and preferably no more than about one-half inch. These dimensions are small enough to provide an effective brush when combined with bristles of other frames.

The second frame 22 has three interconnected legs 22*a*, 22*b* and 22*c* that extend around the periphery of the central frame 21 with a free terminal end of the leg 22*c*. Each of the bristles 14 in the single row of bristles on the second frame 22 is spaced similarly to the bristles 14 on the leg 21*a*, and is spaced from the bristles on the leg 21*a* a similar distance—no more than about one inch and preferably no more than about one-half inch.

The third frame 23 is directly connected to the same cantilever 32 as the first frame 21 and includes four interconnected legs 23*a*, 23*b*, 23*c* and 23*d* that extend around the periphery of the second frame 22. The leg 23*d* has a terminal end that is free. The fourth frame 24 has three legs 24*a*, 24*b* and 24*c*, and extends from both cantilevers 31 and 33, resulting in a direct connection to the same cantilever as the second frame 22. The frame 24 has no free terminal end. The spacing between the bristles 14 in the single rows on the third and fourth frames 23 and 24, respectively, are similar to those on the first and second frames, and are spaced from every next-adjacent bristle on adjacent frames a similar distance.

The spaces (or channels) between the legs of the cantilevers preferably measure about one-eighth of an inch wide, but this is not critical. The spaces can be made wider or narrower, but are preferably in a range of about one-sixteenth to one-quarter of an inch wide. Of course, the spacing between the legs of the frames 21-24 will directly affect the spacing of the bristles on the hairbrush 10. Such spacing and its impact on the functional effectiveness of the hairbrush 10 should therefore be taken into consideration when determining the width of the gaps between the frames 21-24.

As depicted in FIGS. 1-2, the junctures between the legs of the second and third frames 22 and 23 are substantially square and the junctures between the legs of the fourth frame 24 are substantially rounded. This particular configuration is not critical. Any or all of the junctures of the legs can be made substantially square, rounded, or at an angle other than 90 degrees without departing from the present invention.

Referring to FIGS. 1 and 3, the bristles 14 of the hairbrush 10 are preferably of a conventional variety having a substantially cylindrical shape and terminating in small, substantially rounded tips for protecting a user's skin against scratching. However, it is contemplated that any other conventional or well-known variety of bristle can be substituted for the bristles 14 shown. For example, the bristles can be substantially conical and the rounded tips can be omitted. Alternatively, it is contemplated that the bristles can be formed of natural fibers or animal hair with naturally-formed tips. Still further, it is contemplated that the bristles can be formed of metal with sharper tips for the purpose of exfoliation, as is commonly the case with animal grooming brushes.

The bristles 14 are preferably rigidly mounted to the frames 21-24 using a conventional interference fit process whereby the base of each bristle is forcibly driven into a corresponding recess of smaller diameter in the front surface of a respective one of the frames. The base of each bristle is thereby firmly held within its respective recess and cannot be withdrawn except through the application of a strong mechanical force that is generally greater than can or would be applied manually by a human of average strength. Various other mounting means, including adhesives and mechanical fasteners, are contemplated for securing the bristles to their respective frames. The particular mounting means employed can vary greatly and will generally be dictated by the type of bristle that is used.

It will be understood from the above description and drawings that the brush 10 is used in a conventional manner during brushing of the hair of humans and animals. In the process of brushing a human head, the handle is grasped by the person and the tips of the bristles 14 are inserted between the hair fibers on the person's scalp until the tips either contact, or come close to contacting, the scalp. The brush is then moved along the person's head while maintaining close to the initial penetration. The brush is typically moved according to the direction of hair growth, but this is not necessary.

During typical use on an animal, the hairbrush is employed in the manner of a conventional hairbrush with a user holding the handle of the hairbrush and manually dragging the bristles of the hairbrush through the hair or fur of an animal. Employed as described herein, the hairbrush performs in substantially the same manner as a conventional hairbrush to separate hair fibers that are tangled and remove hair fibers that have fallen out of their follicles.

Over the course of use, if the hair fibers are of sufficient length, many of the hair fibers that are removed from a subject's body by the bristles 14 of the hairbrush 10 will accumulate on the bristles 14 in a conventional manner. It is typical for such hair to be pushed toward the base of the bristles 14, which makes it difficult to simply grasp them with a thumb and opposing finger and pull them out from between the bristles. This is typically difficult because the density of the bristles 14, in order to be effective at detangling hair, hinders the insertion of fingers between the bristles.

When a user decides that it is desirable to remove the accumulated hair from the bristles 14 of the hairbrush 10, the user grasps and holds the handle 16 of the brush in one hand. Using the other hand or an object, the user applies a rearward (i.e., from the bristles' tips toward the bases) force to the top, horizontally-oriented leg 24*b* of the frame 24. The rearward force is represented by the letter R and an associated arrow in FIG. 4. As can best be viewed in FIGS. 4-9, when the force is sufficient to bend the cantilevers 31 and 33, and/or the frame 24, at least the free end of the frame 24 is moved rearwardly relative to the handle 16.

As is apparent from FIGS. 4-9, the second frame 22 is bent rearwardly along with the fourth frame 24 when the cantilever 31 is bent rearwardly by the force applied to the fourth frame 24. This is due to the attachment of the second frame 22 and the fourth frame 24 to the cantilever 31. Thus, bending of the cantilever 31 by the force applied to the attached fourth frame 24 effects movement of the attached second frame 22. It is apparent from the illustration of FIG. 4 that the second frame 22 bends rearwardly substantially less than the fourth frame 24. This is due to the fact that the legs 24*a* and 24*c* that connect the frame 24 to the cantilevers 31 and 33 bend at the same time that they transfer to the cantilevers 31 and 33 the rearward force applied to the leg 24*b*. A force applied directly to both of the cantilevers 31 and 33 displaces both the second frame 22 and the fourth frame 24 an equal distance. However, this is not the preferred manner of deflecting the frames relative to one another.

When the rearward force, R is applied to the frame 24, thereby causing the frames 24 and 22 to deflect rearwardly as shown in FIGS. 4-9, the first and third frames 21 and 23 are not deflected a significant distance from their original position (see FIG. 4). Indeed, in the preferred embodiment, deflection of frames 22 and 24 as shown results in little or no deflection of the frames 21 and 23. This selective deflection of the frames 22 and 24 relative to their next-adjacent frames 21 and 23 enlarges the gaps between the next-adjacent frames as compared to their resting state gap size. This enlargement permits a user more space to insert his or her fingers in the larger gaps, as is described next.

In the process of applying a force to the frame 24 and thereby deflecting the frame 22 relative to the handle 16, the user stretches the hair fibers extending between the bristles of adjacent frames to accommodate the larger gaps, or moves them relative to the bristles by the enlargement of the gaps. Once either of these is accomplished, it is very easy to extend human fingers into the enlarged gaps and grasp the hair fibers that extend therebetween. These hair fibers can then be removed manually by pulling using the strength an average person can easily generate. The fibers are then discarded before or after the force deflecting the second and fourth frames is released.

While applying a rearward force to the fourth frame 24, it is contemplated to further apply an opposite, forward force to the third frame 23 to still further widen the gap between the frames 23 and 24 to make hair fiber removal even easier. This is accomplished by the user wedging his or her hand between the third and fourth frames, thereby applying the rearward force to the fourth frame 24 and an opposite, forward force to the third frame 23.

As another alternative method for removing hair fibers woven through the bristles 14 of the brush 10, the fourth frame 24 can be displaced forwardly and then released. If this process is repeated between two and about ten times, hair fibers otherwise trapped around the bristles are gradually worked by this movement toward the tips of the bristles 14. This makes removal of the hair fibers without inserting the fingers in the enlarged gaps between the frames possible and effortless. Once the hair fibers are worked to the tips of the bristles 14, one need merely reach between the tips of the bristles 14 to grasp and pull the hair fibers out. This pulling step need not be carried out while the frames 21-24 are bent relative to one another.

The invention balances the need for a rigid structure that can be used to effectively brush the hair of a person or animal with the need for some flexibility in order that the cantilevers permit the frames of the head to be angled relative to the handle and other frames. In the preferred embodiment, this is accomplished by using a single material, such as a polymer, throughout the handle, cantilevers and frames. Deliberately shaping this material at the cantilevers allows the device to perform as a brush when used to brush hair, and permits deflection of the frames that can be effected by the average person. The appearance, shape and size of the brush can be modified from that shown if another material is used. Furthermore, the chemical makeup of the material is preferably the same throughout the brush, even though the brush has different characteristics in selected locations. For example, a metal brush can be locally heat-treated or worked to have significant elasticity only at the cantilevers. Still further, a plastic brush can have fiber-reinforcement only at the cantilevers. Other possibilities will become apparent to the person of ordinary skill from this description.

Figure 10:
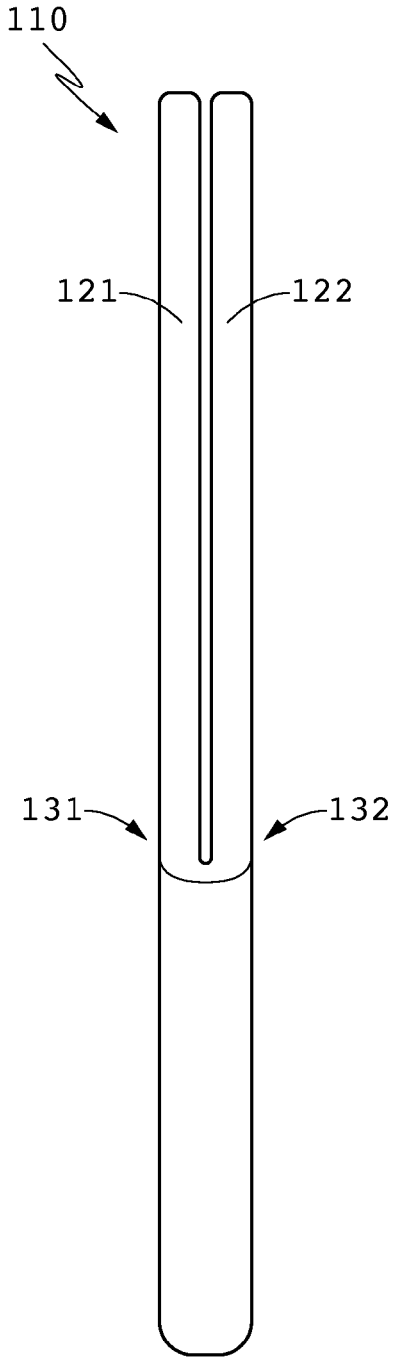
FIG. 10 is a rear view illustrating an alternative embodiment of the present invention.
Figure 11:
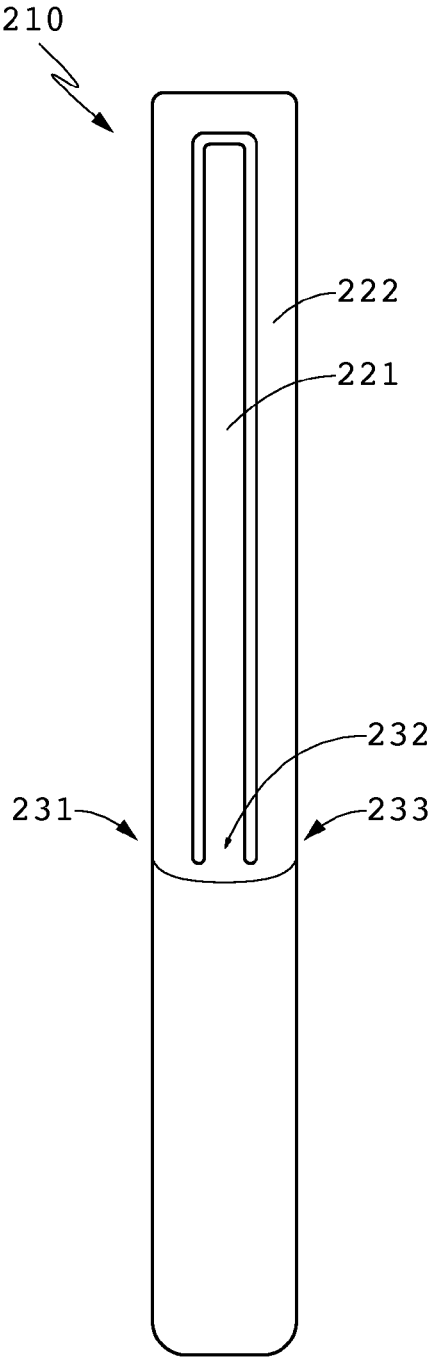
FIG. 11 is a rear view illustrating an alternative embodiment of the present invention.
Figure 12:
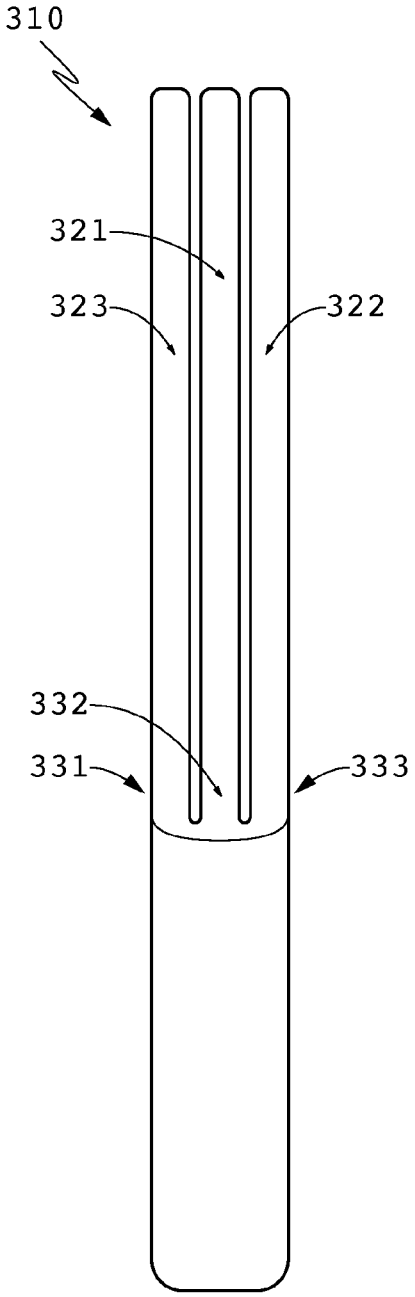
FIG. 12 is a rear view illustrating an alternative embodiment of the present invention.
Figure 13:
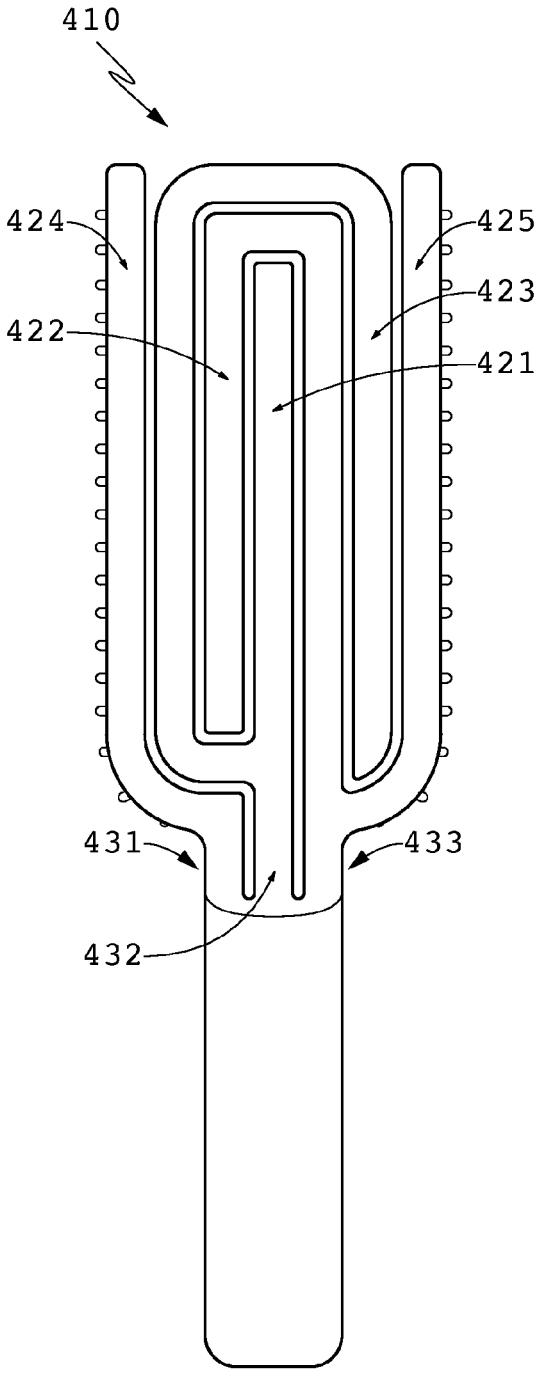
FIG. 13 is a rear view illustrating an alternative embodiment of the present invention.

Other variations on the preferred embodiment, which are too numerous to fully describe, are possible. For example, fifth, sixth and more frames can be added to the brush 10, along with fourth, fifth and more cantilevers. A minimum of two cantilevers 131 and 132 and two frames 121 and 122 is necessary, as illustrated on the brush 110 in FIG. 10. The brush 210 in FIG. 11 has two frames 221 and 222 and three cantilevers 231, 232 and 233. The brush 310 in FIG. 12 has three frames 321, 322 and 323 and three cantilevers 331, 332 and 333. The brush 410 in FIG. 13 has five frames 421, 422, 423, 424 and 425 and three cantilevers 431, 432 and 433.

It should be noted that the principle of the invention can be incorporated into leaf rakes, spatulas, tongs, and any other device that grips or encloses another object or objects. For example, although not illustrated, a spatula using a handle with a first frame that can support a pancake (or other object being cooked on a hot surface) can be used to slide the first frame beneath the pancake. By a force applied to a second frame one can cause the second frame to open to permit the pancake to be slid therebetween. Upon release of the force applied to the second frame, the frames return toward their original position with the pancake interposed therebetween. The spring force of the cantilevers thus sandwiches the pancake between one frame and another frame for support during flipping of the pancake. The same principle can be applied to a rake, in which leaves are collected between two or more frames and then released when placed in a container.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An improved hair brush having a hand-grippable handle attached to a head with a plurality of spaced bristles extending from the head, the improvement comprising:

(a) the head formed by at least first and second substantially coplanar frames, the first frame being spaced from the second frame by a gap;

(b) a first cantilever interposed between the first frame and the handle;

(c) a second cantilever interposed between the second frame and the handle, wherein the second frame is configured to move relative to the first frame and the handle;

(d) the head formed by a third and fourth frames, the third frame mounted to the first cantilever and defining a gap between the second and third frames, the third frame having bristles mounted thereto;

(e) a third cantilever mounted to the handle and spaced from the first cantilever; and (f) the fourth frame mounted to the second and third cantilevers and defining a gap between the third and fourth frames, the fourth frame having bristles mounted thereto, wherein the third and fourth frames are substantially coplanar with the first and second frames.

2. The hair brush in accordance with claim 1, wherein the first cantilever and the second cantilever are contiguous with the handle and their respective frames.

3. The hair brush in accordance with claim 1, wherein the frames are disposed concentrically around one another.

4. The hair brush in accordance with claim 1, wherein the bristles mounted to each frame are aligned in a single row.

5. The hair brush in accordance with claim 4, wherein the bristles of each frames' row are spaced no greater than about one-half inch from each next-adjacent bristle in that frames' row.

6. The hair brush in accordance with claim 5, wherein the bristles of each frames' row are spaced no greater than about one-half inch from each next-adjacent bristle in each next-adjacent frames' row.

7. A hair brush comprising:

(a) a hand-grippable handle;

(b) a first cantilever mounted to the handle;

(c) a second cantilever mounted to the handle spaced from the first cantilever;

(d) a first frame mounted to the first cantilever, the first frame having bristles mounted thereto;

(e) a second frame mounted to the second cantilever adjacent, and substantially coplanar with, the first frame and forming a gap between the first and second frames, the second frame having bristles mounted thereto;

(f) a third frame mounted to the first cantilever and defining a gap between the second and third frames, the third frame having bristles mounted thereto;

(g) a third cantilever mounted to the handle and spaced from the first cantilever; and (h) a fourth frame mounted to the second and third cantilevers and defining a gap between the third and fourth frames, the fourth frame having bristles mounted thereto, wherein the third and fourth frames are substantially coplanar with the first and second frames.

8. The hair brush in accordance with claim 7, wherein the first cantilever and the second cantilever are contiguous with the handle and their respective frames.

9. The hair brush in accordance with claim 7, wherein the frames are disposed concentrically around one another.

10. The hair brush in accordance with claim 7, wherein the bristles mounted to each frame are aligned in a single row.

11. The hair brush in accordance with claim 10, wherein the bristles of each frames' row are spaced no greater than about one-half inch from each next-adjacent bristle in that frames' row.

12. The hair brush in accordance with claim 11, wherein the bristles of each frames' row are spaced no greater than about one-half inch from each next-adjacent bristle in each next-adjacent frames' row.

* * * * *